United States Patent [19]

Wieland et al.

[11] Patent Number: 4,559,725

[45] Date of Patent: Dec. 24, 1985

[54] ROTARY TILLER FOR MAINTAINING CROSS COUNTRY SKI TRAILS

[75] Inventors: Erwin H. Wieland, Senden; Walter Haug, Blaustein, both of Fed. Rep. of Germany

[73] Assignee: Karl Kassbohrer Fahrzeugwerke GmbH, Ulm, Fed. Rep. of Germany

[21] Appl. No.: 650,450

[22] Filed: Sep. 14, 1984

[30] Foreign Application Priority Data

Sep. 20, 1983 [DE] Fed. Rep. of Germany ..... 3333941

[51] Int. Cl.[4] ..... E01H 5/00

[52] U.S. Cl. ..... 37/197; 37/222

[58] Field of Search ..... 37/220, 222, 223, 224, 37/197; 172/540, 548, 549, 554, 46, 51, 68, 122–123, 154, 158, 172, 173, 177, 185, 187; 404/90

[56] References Cited

U.S. PATENT DOCUMENTS

| | | | |
|---|---|---|---|
| 1,132,152 | 3/1915 | Bell | 172/548 X |
| 2,786,283 | 3/1957 | Bradley | 37/222 |
| 3,652,106 | 3/1972 | Waterman | 172/158 X |
| 3,794,122 | 2/1974 | Rohrer | 172/68 |
| 4,057,916 | 11/1977 | Roemer | 37/223 |
| 4,195,695 | 4/1980 | Dixon | 172/185 X |
| 4,282,666 | 8/1981 | Brandt | 172/540 |
| 4,360,065 | 11/1982 | Jewison et al. | 172/122 |
| 4,391,051 | 7/1983 | Bachler | 37/223 |

FOREIGN PATENT DOCUMENTS

| | | | |
|---|---|---|---|
| 309599 | 9/1916 | Fed. Rep. of Germany | 172/185 |
| 2357958 | 5/1974 | Fed. Rep. of Germany | 172/548 |
| 6803684 | 9/1969 | Netherlands | 172/554 |
| 1145732 | 3/1969 | United Kingdom | 172/123 |
| 869589 | 10/1981 | U.S.S.R. | 172/123 |

*Primary Examiner*—E. H. Eickholt

*Attorney, Agent, or Firm*—Maurice E. Gauthier

[57] ABSTRACT

A rotary tiller for maintaining cross country ski trails has a rotary shaft with at least one array of radially extending first cutters flanked by laterally adjacent arrays of radially extending second cutters. The radial lengths of the first cutters are greater than the radial lengths of the second cutters. The first cutters are arranged to till a center ski track and the second cutters are arranged to till pole tracks on either side of the ski track, with the ski tracks having a tilled depth greater than that of the pole tracks.

3 Claims, 3 Drawing Figures

ROTARY TILLER FOR MAINTAINING CROSS COUNTRY SKI TRAILS

BACKGROUND OF THE INVENTION

1. Field of the Invention

This invention relates generally to rotary tillers, and in particular to those tillers used to maintain cross country ski trails.

2. Description of the Prior Art

Rotary tillers have been employed in the past for maintaining cross country ski trails. Such tillers are normally provided with a rotatably driven tiller shaft having an array of radial cutters. The shaft is aligned perpendicular to the running direction of the vehicle. To simplify the maintenance of the cross country ski trail and also to make it cheaper, the tiller shaft is built wide enough so that it covers two adjoining cross country ski tracks together with the associated pole tracks. It thus extends altogether over two pairs of cross country ski tracks and a total of four adjacent pole tracks, which respectively run parallel to the cross country tracks. The cutters of the tiller shaft all have a uniform length.

The known rotary tiller has proven itself in practice. In one working step, it can create or again refurbish both the cross country ski track which leads to the destination as well as the return track. In the case of refurbishing the track, the tiller tills the existing tracks by comminuting the snow down to a certain depth and mixing the upper layer with the lower layer. A trailing track unit then impresses the cross country ski tracks into the freshly prepared snow.

Although such conventional rotary tillers work reliably, they suffer from one disadvantage in that a substantial amount of power is required in order to tow them, particularly where the trails are severely iced. Thus, vehicles with relatively small engines have considerable difficulty in towing the tillers.

SUMMARY OF THE PRESENT INVENTION

The present invention has as its basic objective the provision of a rotary tiller of the type mentioned in the introduction, by means of which the cross country ski tracks can be formed as well as is the case with the known rotary tiller, but with a reduced expenditure of power.

According to the present invention, this objective is achieved by providing a tiller shaft having long cutters in a region that is associated with the pair of cross country ski tracks and by its having short cutters in the two adjacent regions that are associated with the pole tracks.

The invention has a simple structure and works reliably. It distinguishes between the ski tracks on the one hand and the pole tracks on the other hand. In the region of the ski tracks, it uses the longer cutters, while the shorter cutters are used for the pole tracks. This arrangement achieves manifold advantages. First of all, a rotary tiller according to the invention consumes considerably less driving power as compared to conventional tillers. This is a decisive advantage because snowmobiles with relatively weak engines often are used for maintaining cross country ski trails, particularly those operated by municipalities.

In addition to achieving a reduction in power consumption, the present invention also improves the cross country ski tracks themselves.

As explained previously, the ski tracks are formed by a trailer unit which trails after the tiller. With a tiller in accordance with the present invention, the long cutters that are associated with the ski tracks till out a U-bed for the trailer unit. The trailer unit then impresses the ski tracks into the U-bed. The regions of the pole tracks are processed by the short cutters. The base of the U-bed lies lower than the regions of the pole tracks by the difference in length between the short and long cutters. The U-bed provides the precondition for a more stable version of the ski tracks. On the one hand, due to the long cutters, the upper and lower layers of the snow are more thoroughly mixed together in the U-bed; on the other hand, the ski tracks receive a more compact shape when they are impressed by the trailer unit, since the ski tracks are impressed within the U-bed, and the sidewalls at the bottom form an abutment during the impressing process.

The tiller of the present invention thus makes it possible to work the area of the ski tracks. As regards the pole tracks which are adjacent to the ski tracks, one uses the short cutters, which do not loosen up the snow as deeply and thus help to conserve energy.

This also allows a hard layer of snow to remain intact beneath the pole tracks. This is an advantage to the cross country skier, since the pole then sinks to a solid support base.

The fact that the tiller is equipped in sections with long and short cutters entails still a further advantage, namely that the tiller is in a certain sense self-centering while it is running. The cutters that engage at a greater depth here apply self-guiding forces which guide the tiller behind the tractor vehicle.

In a preferred further development of the invention, the design is such that the ratio of the length of the long cutters to the short cutters is about 3:2. This length ratio not only minimizes the expenditure of energy but also achieves a reasonable work-up of both the ski tracks and the associated pole tracks.

BRIEF DESCRIPTION OF THE DRAWINGS

FIG. 1 shows a snowmobile-type vehicle 1 of the usual type. It has a driver's cab 2 and a rearwardly extending load carrying bed 3, as well as two caterpillar tracks 4 which are guided over the driving wheels 5. A trailer frame 6 is disposed at the rear of the vehicle. Viewed in the running direction (right to left in FIGS. 1 and 2), the trailer frame is connected at the front with the vehicle through a coupling 7. The coupling 7 is of the type which accommodates both horizontal and vertical pivoting motion of the trailer frame with respect to the vehicle.

At its rear end, the load carrying bed 3 has vertical supports 8 which are disposed laterally on either side of the longitudinal center axis L of the vehicle. Supports 8 are used for mounting two positioning devices 9 on the vehicle. In the present case, the positioning devices 9 are connected in a trapezoidal arrangement to a carrier pipe of the trailer frame 6, which extends along the longitudinal axis L of the vehicle.

Figure 1:
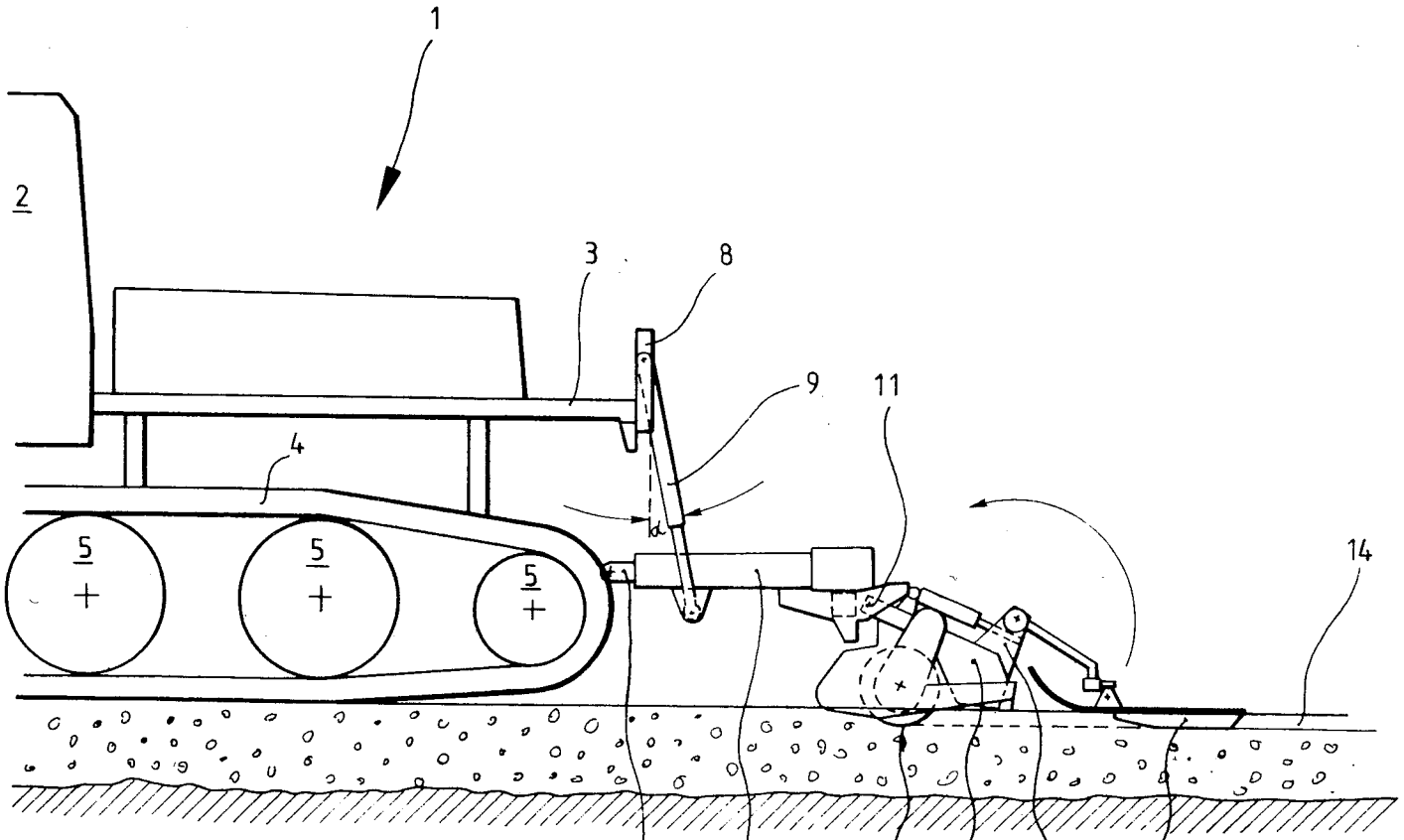
FIG. 1 is a side view of a snowmobile together with a rotary tiller in accordance with the invention.

From FIG. 1 it can be seen that the positioning devices 9 are directed steeply downwards from the rear of the vehicle. All bearings of the positioning devices are arranged so that they make possible the lateral swiveling of the trailer frame 6 with respect to the vehicle 1.

Figure 2:
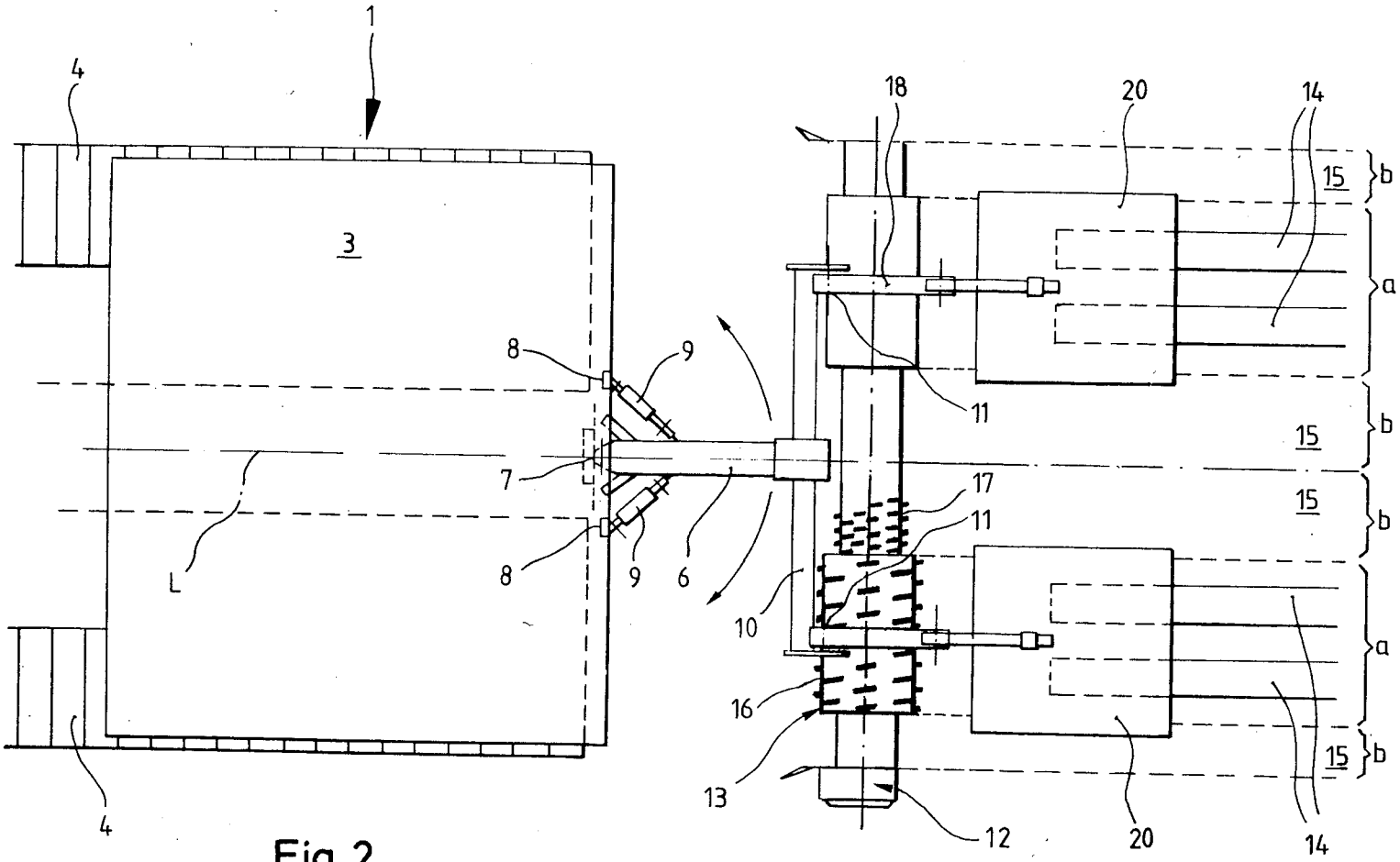
FIG. 2 is a top plan view of the vehicle and equipment shown in FIG. 2.
Figure 3:
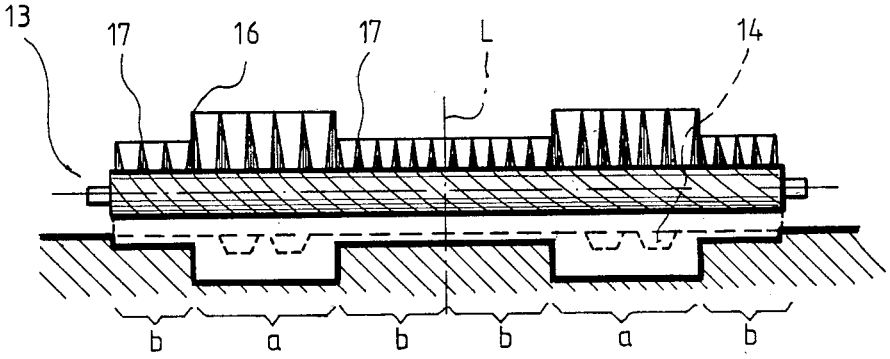
FIG. 3 is a partial sectional view through the tiller shaft.

A horizontal distributing support 10 is provided at the rear end of the carrier pipe of the trailer frame 6. A rotary tiller 12 depends from on the support and is pivotable about a horizontal axis 11. The tiller comprises a horizontal shaft 13, whose design is best shown in FIGS. 2 and 3. The tiller shaft is about as wide as the snowmobile 1. It thus covers two mutually parallel pairs of ski tracks 14 as well as the two respectively associated pole tracks 15, each of which is adjacent to one pair of ski tracks. The tiller shaft according to the invention has cutters of different lengths. The longer cutters are disposed in the region a, which is associated with the ski tracks 14, while the shorter cutters are disposed in the regions b of the pole tracks. The ratio of the lengths of the long and the short cutters is about 3:2.

FIG. 3 shows in section the tiller shaft and the snow section that is processed thereby. The tiller shaft has a symmetrical structure with respect to the longitudinal center axis L. In each symmetrical half, a region a exists, approximately centered, with long cutters 16. These are always flanked on both sides by the regions b, in which are situated the short cutters 17. The short cutters can be disposed more closely to one another than the longer cutters.

Due to the different lengths of the cutters, the snow in regions a is tilled more deeply than in the regions b. This therefore results in an approximately U-shaped bed for the ski tracks 14, which are shown in FIG. 3 by dashed lines.

In the regions b, which are associated with the pole tracks 15, the tiller works to a lesser depth than in the regions a, by the difference in length between the cutters 16 and 17. The working in region b is relatively slight. The lowermost hard snow layer remains intact. The shorter cutters permit a reduction of the power required to drive the shaft.

Connecting supports 18 extend rearwardly from the ends of the distributing supports 10. Supports 19 protrude upwardly at an angle from the free ends of the supports 18. The ski track units 20 of the usual type are hinged to supports 19, so as to be pivotable about horizontal axes.

The rotary tiller is pivotably fastened to the vehicle by way of the trailer frame. The carrier pipe of the trailer frame 6 can be pivoted about its own longitudinal axis, so as to accommodate twisting of the rotary tiller with respect to the vehicle.

During operation, the vehicle runs along a snow covered surface such as is shown, for example, in simplified fashion in FIG. 1. The trailer frame is in a nearly horizontal position. The rotary tiller digs into the surface that has been pre-worked to some extent by the vehicle tracks 4 and tills the snow in regions a and b to the previously described different depths. The positioning devices 9 either are passive, so that the tiller is pressed into the snow surface by virtue of its own weight and the weight of the trailer frame, or alternatively the positioning devices can operate to press the trailer frame downwardly.

The ski track units 20 are likewise situated on the snow surface and follow the rotary tiller. They impress the parallel ski tracks 14 into the snow in the regions a, and the pole tracks 15 in the regions b.

We claim:

1. A method of maintaining a cross country ski trail having a center ski trail area flanked by adjacent pole track areas, comprising: tilling the ski track area to a first depth while simultaneously tilling the pole track area to a second depth which is less than said first depth, and impressing parallel ski tracks in the thus tilled ski track area.

2. The method of claim 1 wherein the tilling is performed by means of a rotary shaft carrying radially extending cutters, the lengths of the cutters employed to till the ski track area being greater than the lengths of the cutters employed to till the pole track areas.

3. The method in accordance with any one of claims 1 or 2 wherein multiple ski trails are maintained simultaneously.

* * * * *